US006367465B1

(12) United States Patent
Buccieri, Jr.

(10) Patent No.: US 6,367,465 B1
(45) Date of Patent: Apr. 9, 2002

(54) TRIGGER EXTENSION FOR PAINT BALL MARKER GUN

(76) Inventor: Alfred N. Buccieri, Jr., 6 Berwick Rd., Brewster, NY (US) 10509

( * ) Notice: Subject to any disclaimer, the term of this patent is extended or adjusted under 35 U.S.C. 154(b) by 0 days.

(21) Appl. No.: 09/649,952

(22) Filed: Aug. 29, 2000

(51) Int. Cl.[7] ..... F41B 11/00

(52) U.S. Cl. ..... 124/31; 124/74; 42/69.01; 89/27.3

(58) Field of Search ..... 42/65, 69.01, 106; 89/27.3, 136; 124/31, 56, 72, 73, 74, 76

(56) References Cited

U.S. PATENT DOCUMENTS

| | | | | |
|---|---|---|---|---|
| 851,626 A | * | 4/1907 | Keyse | |
| 1,513,654 A | * | 10/1924 | Thompson | |
| 2,920,413 A | * | 1/1960 | Marhefka et al. | |
| 3,142,926 A | * | 8/1964 | Morrow | |
| 3,188,764 A | * | 6/1965 | Harding | |
| 4,276,808 A | | 7/1981 | York | 89/136 |
| 4,787,288 A | | 11/1988 | Miller | 89/27.3 |
| 4,803,910 A | * | 2/1989 | Troncoso | |

* cited by examiner

*Primary Examiner*—John A. Ricci
(74) *Attorney, Agent, or Firm*—Lackenbach Siegal Marzullo Aronson & Greenspan, P.C.

(57) ABSTRACT

A trigger extension device attached to a trigger of a paint ball marker gun used in the sport of paint ball marking. A trigger extension bar attached to the trigger at a transverse orientation at a distance from the trigger provides a grip for a user to fan the trigger at a high rate of speed at a position external to the trigger. The trigger extension bar is connected to the trigger in transverse orientation to the left and right side walls of the trigger. The trigger extension bar is linear and is perpendicular to the left and right trigger walls. The distal end of the trigger extension bar can optionally include an angled portion. The trigger extension bar can extend from either the left or right side of the marker gun trigger or can extend from both sides of the marker gun trigger. The trigger extension bar can be connected to the trigger by an extension screw that is threaded through a threaded hole in the trigger and also mounted to an axial threaded bore in the trigger extension bar. Alternatively, the trigger can be positioned in a recess in the trigger extension bar which in turn is mounted in cutout in the trigger where it is held by a set screw.

19 Claims, 7 Drawing Sheets

FIG. 3
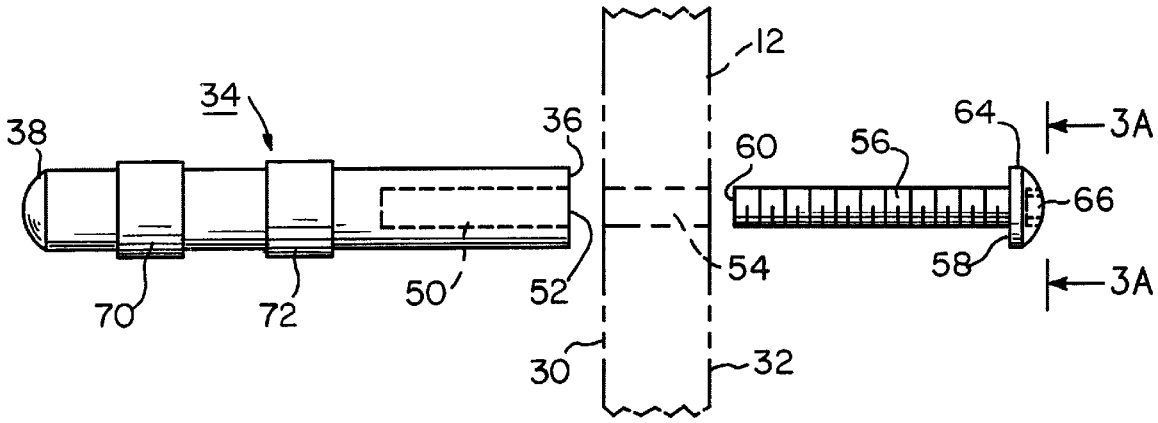
FIG. 3A
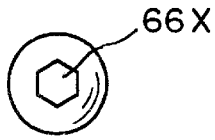
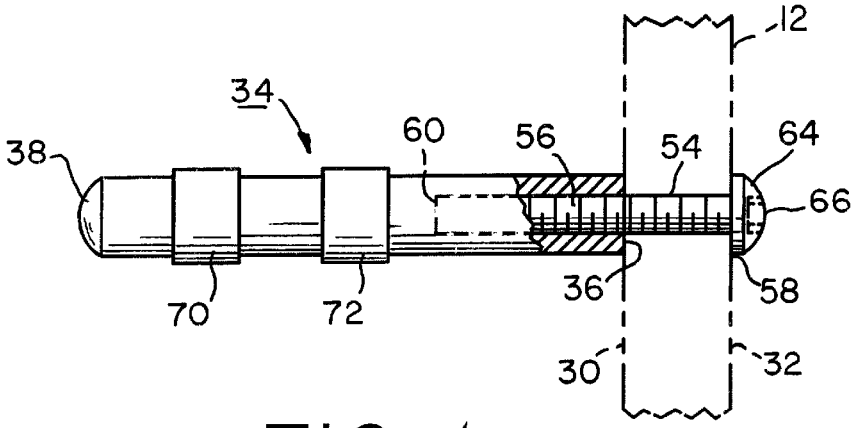
FIG. 4

TRIGGER EXTENSION FOR PAINT BALL MARKER GUN

FIELD OF THE INVENTION

The present invention relates generally to paint ball marker guns and more particularly to the operation of the triggers for paint ball marker guns.

DESCRIPTION OF THE PRIOR ART

A paint ball marker gun is used in the well-known sport of paint ball marking, or paint ball, which has the goal of marking designated impact areas with a ball filled with a water-based paint that is variously colored in accordance with the color assigned to each person or team. The paint ball marker gun originated about 25 years ago as an industrial tool, for example, tree marking and animal marking. The industrial tool has developed into the sport of paint ball marking, or paint ball. The paint ball marker gun is analogous to the general construction of the common hand gun in that each has a gun barrel, a hand grip, and a trigger with a trigger guard. The paint ball marker gun, however, is loaded with clips of paint balls rather than bullets. The ejection capability of the marker gun is powered by a compressed gas, such as compressed carbon dioxide or nitrogen in a manner known in the art. The paint balls are fired one by one by action of pulling the trigger of the paint ball gun to activate the ejection mechanism, for firing each paint ball. The number of paint ball shots that can be fired by each player can be over 1000 during a contest. Operation of the trigger often creates fatigue to the hand and the finger of the player. The sport is often played in cold weather, and some difficulty is encountered in operating the trigger when wearing gloves. In addition, as a result of the described problems, the time expended over the span of many games is unnecessarily extended.

SUMMARY OF THE INVENTION

It is therefor an object of the present invention to provide a device that will significantly increase the efficiency of firing a paint ball marker gun, reduce the amount of energy expended in firing a paint ball marker gun, and greatly increase the rate of firing a paint ball marker ball gun.

It is another object of the present invention to provide a trigger device that will significantly and ergonomically increase the efficiency of activating the trigger of a paint ball marker gun.

In accordance with these and other objects that will become apparent in the course of this disclosure, there is provided a hand-held programmable sign comprising a trigger extension device attached to a trigger of a paint ball marker gun used in the sport of paint ball marking. A trigger extension bar attached to the trigger at a transverse orientation at a distance from the trigger provides a grip for a user to activate, or fan, the trigger at a high rate of speed at a position remote from the trigger. The trigger extension bar is connected to the trigger in transverse orientation to the left and right side walls of the trigger. The trigger extension bar is linear and is perpendicular to the left and right trigger walls. The distal end of the trigger extension bar can optionally have an angled portion added thereto. The trigger extension bar can extend from either the left or right side of the marker gun trigger or can extend from both sides of the marker gun trigger. The trigger extension bar can be connected to the trigger by an extension screw that is threaded through a threaded hole in the trigger that is also mounted to an axial threaded bore in the trigger extension bar. Alternatively, the trigger can be positioned in a recess in the trigger extension bar which in turn is mounted in a cutout in the trigger where it is held by a set screw.

The present invention will be better understood and the objects and important features, other than those specifically set forth above, will become apparent when consideration is given to the following details and description, which when taken in conjunction with the annexed drawings, describes, illustrates, and shows preferred embodiments or modifications of the present invention and what is presently considered and believed to be the best mode of practice in the principles thereof.

Other embodiments or modifications may be suggested to those having the benefit of the teachings therein, and such other embodiments or modifications are intended to be reserved especially as they fall within the scope and spirit of the subjoined claims.

DESCRIPTION OF THE DRAWINGS

FIG. 3 shows a side view of the trigger extension device taken behind the trigger area of the marker gun shown in FIG. 3, which is shown in phantom line, with an exploded view of the trigger extension bar and an elongated screw in a preassembled mode of the trigger extension device with two gripping bands mounted to the trigger extension bar;

FIG. 3A is a view taken at line 3A—3A shown in FIG. 3 showing the locking cap of the elongated screw having a recess for receiving an Allen wrench;

FIG. 4 is an assembled mode of the trigger extension device shown in FIG. 3 with the trigger extension bar partially stripped away showing the threaded screw with the trigger shown in phantom line and two gripping bands mounted to the trigger extension bar;

DESCRIPTION OF THE PREFERRED EMBODIMENT

Figure 2:
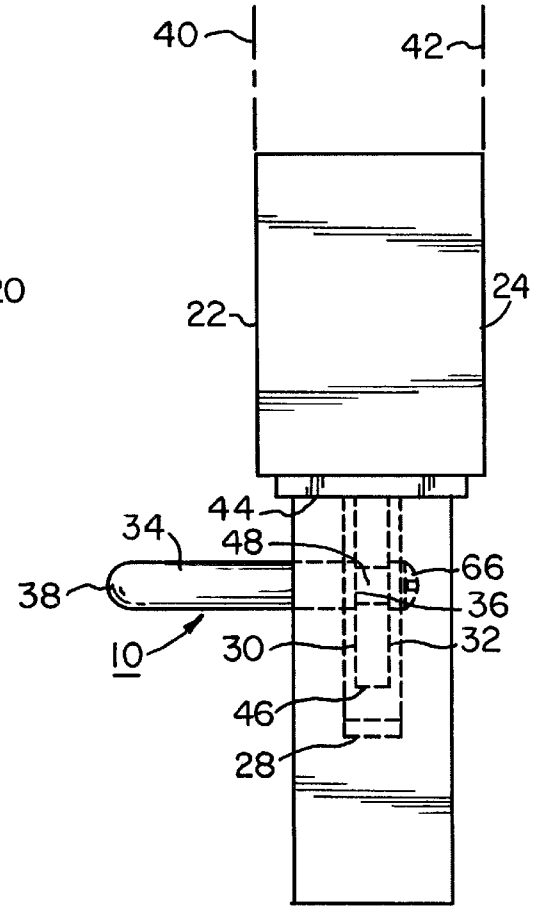
FIG. 2 is a rear view of the marker gun shown in FIG. 1.

Reference is now made to the drawings and in particular to FIGS. 1–13 in which identical or similar parts are designated by the same reference numerals throughout.

Figure 1:
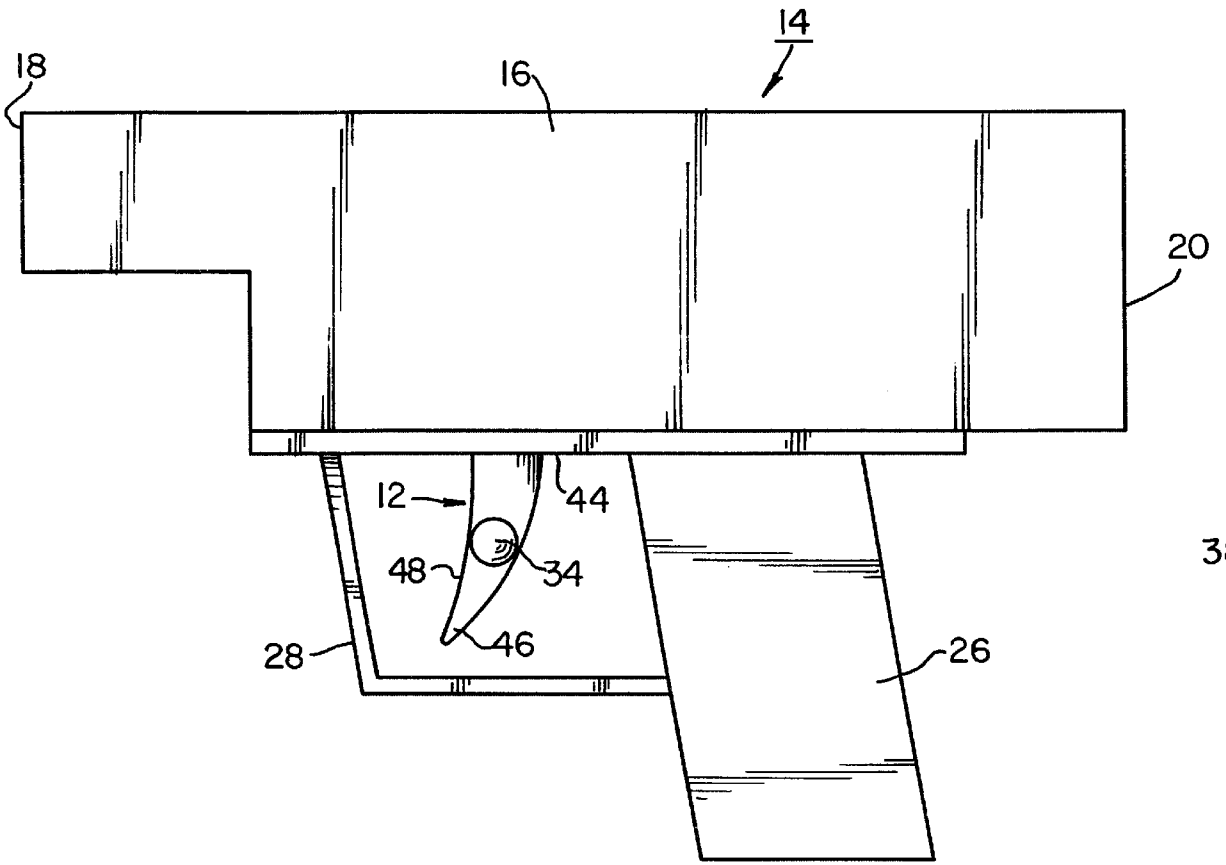
FIG. 1 is a side view of a paint ball marker gun including a broken view of the gun body with a hand grip, a trigger guard and a trigger with a cylindrical trigger extension device attached to the trigger and extending from the left side of the marker gun.

FIGS. 1 and 2 shows a trigger attachment device 10 attached to a trigger 12 of a paint ball marker gun 14. Trigger 12 is shown to be slightly arcuate in configuration with the arc of the curve being inward relative to the user for purpose of providing a better grip as is known in the art. Marker gun 14 includes a gun body 16 in FIG. 1 and in rear view in FIG. 2 with the front of gun 14 being represented by gun nozzle 18 positioned to the right of FIG. 1 and the rear portion 20 shown to the left in FIG. 1 so that the left side 22 of gun 18 is shown in FIG. 1 and the left and right sides 22 and 24, respectively, of gun 14 are shown in FIG. 2. Gun grip 26 is attached to the underside of gun body 16 and trigger 12 is positioned forward of grip 26. A trigger guard 28 attached to the underside of gun body 16 and gun grip 26 encloses trigger 12.

Trigger attachment device 10 as shown in FIG. 2 extends outwardly from left side 22 of gun body 16 for purposes of exposition only. As shown in FIGS. 2, 3 and 4 and as also as shown in the alternate embodiment of FIG. 5, trigger attachment device 10 likewise extends outwardly from the left side 22 of gun body 16. The leftward extending aspect of trigger attachment 10 provides a user the opportunity to hold marker gun 14 with the right hand and to operate trigger 12 by striking the forward side of trigger attachment device 10 with the palm or fingers of the left hand with a rearward motion, that is, from gun front portion 18 towards gun rear portion 20, with the result that trigger 12 is pulled rearwardly so as to activate the firing mechanism of marker gun 14 to fire a paint ball.

Trigger 12 has trigger left and right side planar walls 40 and 42, respectively, that are in association with left and right sides walls 22 and 24, respectively, of gun body 16. Trigger attachment device 10 includes a trigger extension bar 34 that has opposed bar proximal and distal ends 36 and 38, respectively, with bar proximal end 36 positioned adjacent to left trigger side wall 30 and bar distal end 38 positioned remote from trigger left side wall 30 so that bar distal end 38 is located on left side 22 of gun body 16. Bar distal end 38 is located beyond the left vertical plane 40 of gun body 16. Trigger extension bar 34 is transverse to trigger 12, and in particular is transverse to trigger left side wall 30. In particular, trigger extension bar 34 is positioned to allow a user to operate trigger 12 by the left hand of fingers of the user external to trigger 12, by pulling or striking trigger extension bar 34 in a rearward direction relative to marker gun 14 towards the body of the user, which operation causes trigger 12 to move backwards as if directly operated by the user to activate the firing mechanism of marker gun 14 although the hand of the user is remote from trigger 12.

Trigger extension bar 34 is cylindrical and linear and is connected to trigger 12. Trigger 12 has a trigger connecting end 44 located at gun body 16 and a trigger free end 46 with trigger gripping portion 48 therebetween with extension bar proximal end 36 being located at trigger gripping portion 48. Trigger extension bar 34 defines an extension bar cylindrical threaded bore 50 having a bore circular aperture 52 at proximal end 36. Trigger 12 defines a threaded trigger hole 54 at trigger gripping portion 48 that extends perpendicularly between trigger left and right side walls 30 and 32. An elongated screw 56 has a screw secured end 58 and an opposed screw distal end 60. Elongated screw 56 is threadably mounted in extension bar threaded bore 50 with screw distal end 60 being positioned therein.

Screw secured end 58 has a screw locking cap 64 positioned adjacent to trigger right side wall 32. Screw locking cap 64 is positioned adjacent to trigger right side wall 32. Trigger 12 is positioned between screw locking cap 64 and bar proximal end 36 so that trigger extension bar 34 and trigger 12 are held in interlocked relationship. Screw locking cap 64 defines either a cross-slot 66 for receiving the head of a screwdriver as shown in FIG. 1 or a recess 66A for receiving the head of an Allen wrench as shown in FIG. 3.

Two optional cylindrical bands 70 and 72 are mounted in spaced relationship around cylindrical trigger extension bar 34. Bands 70 and 72 are frictionally resistant to the movement of the hand of a user so that the hand achieves added grip during the pulling or striking action of the trigger activation. Bands 70 and 72 can be made of a variety of materials, among them being rubber, heat-shrunk rubber, and biasable plastic. Bands 70 and 72 can be made of one of a variety of colors for the purpose of identifying the user as an identifiable competitor or as a member of a particular team.

Figure 5:
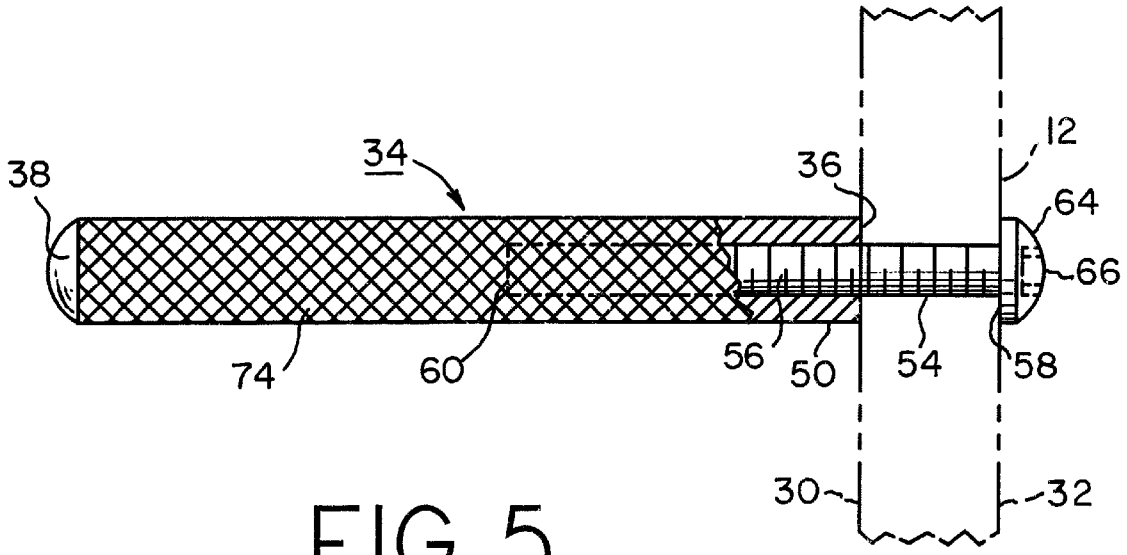
FIG. 5 is a side view analogous to the view shown in FIG. 4 with the trigger extension bar having a knurled gripping surface with the trigger shown in phantom line.

As shown in FIG. 5, trigger extension device 10 shows a trigger extension bar 34 optionally provided with a knurled surface 74 to provide frictional grip for the hand of the user during the pulling or striking action against trigger extension bar 34 of the trigger activation.

Figure 6:
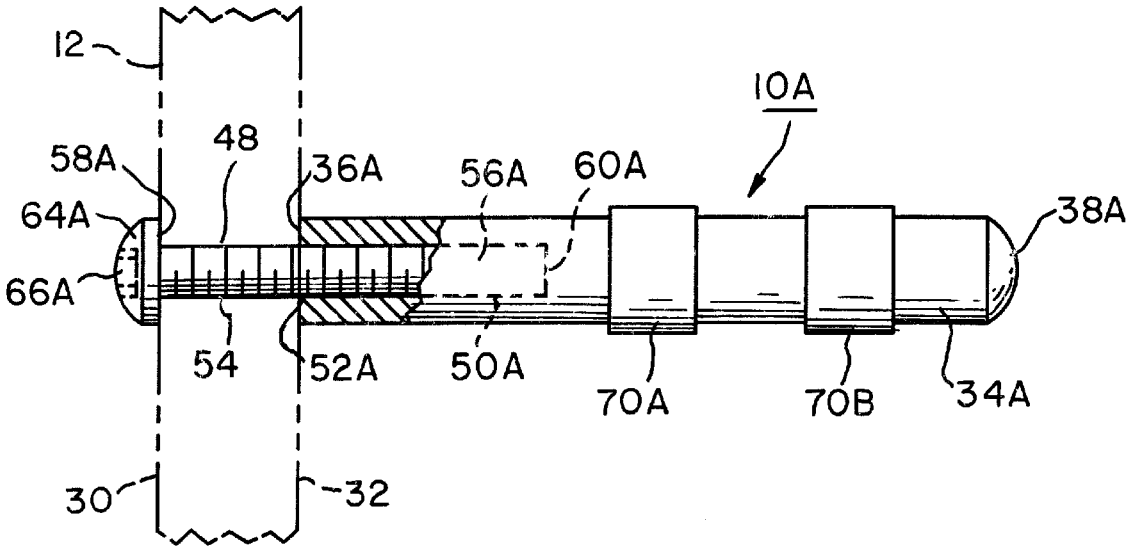
FIG. 6 is a side view of a trigger extension device analogous to the device shown in FIG. 4 with the trigger extension bar shown extending from the right side of the marker gun.

FIG. 6 is a view of a trigger attachment device 10A, which is directly analogous to trigger attachment device 10 shown in FIGS. 1–5 with trigger attachment device 10A being located on right side 24 relative to gun body 16. In FIG. 6 as in FIGS. 1–5, trigger 12 has trigger left and right side planar walls 30 and 32, respectively, that are in association with left and right sides walls 22 and 24, respectively, of gun body 16. Trigger attachment device 10A includes a trigger extension bar 34A that has opposed proximal and distal ends 36A and 38A, respectively, with proximal end 36A positioned adjacent to trigger right side wall 32 and distal end 38A positioned remote from trigger right side wall 32. The rightward extending aspect of trigger attachment device 10A as shown in FIG. 6 provides a user the opportunity to hold marker gun 14 in the left hand and to operate trigger 12 by striking the forward side of trigger attachment device 10A with the palm or fingers of the right hand with a rearward motion, that is, from gun front portion 18 towards gun rear portion 20, with the result that trigger 12 is pulled rearwardly so as to activate the firing mechanism of marker gun 14 to fire a paint ball.

Trigger attachment device 10A includes a trigger extension bar 34A that has opposed bar proximal and distal ends 36A and 38A, respectively, with bar proximal end 36A positioned adjacent to trigger right side wall 32 and bar distal end 38A positioned remote from trigger right side wall 32 so that bar distal end 38A is located on right side 24 of gun body 16. Bar distal end 38A is located beyond the right vertical plane 42 (seen in FIG. 2) of gun body 16. Trigger extension bar 34A is transverse to trigger 12, and in particular is transverse to trigger right side wall 32. Trigger extension bar 34A is positioned to allow a user to operate trigger 12 by the right hand of fingers of the user external to trigger 12, by pulling or striking trigger extension bar 34A in a rearward direction relative to marker gun 14 towards the body of the user, which operation causes trigger 12 to move backwards as if directly operated by the user to activate the firing mechanism of marker gun 14 although the hand of the user is remote from trigger 12.

Trigger extension bar 34A defines an extension bar cylindrical threaded bore 50A having a bore circular aperture 52A at bar proximal end 36. Trigger 12 defines a threaded trigger hole 54 at trigger gripping portion 48 that extends perpendicularly between trigger left and right side walls 30 and 32. An elongated screw 56A has a screw secured end 58A and an opposed screw distal end 60A. Elongated screw 56A is threadably mounted in extension bar threaded bore 50A with screw distal end 60A being positioned therein.

Screw secured end 58A has a screw locking cap 64A positioned adjacent to trigger left side wall 30. Trigger 12 is positioned between screw locking cap 64A and bar proximal end 36A so that trigger extension bar 34A and trigger 12 are held in interlocked relationship. Screw locking cap 64A defines either a cross-slot 66A for receiving the head of a screwdriver as shown in FIG. 1, or optionally it can define a slot for receiving the head of an Allen wrench as shown in FIG. 3A.

Two optional circular, or cylindrical, bands 70A and 72A are mounted in spaced relationship around cylindrical trigger extension bar 34A. Bands 70A and 72A are frictionally resistant to the movement of the hand of a user so that the hand achieves added grip during the pulling or striking action of the trigger activation. Bands 70A and 72A can be made of a variety of materials, among them being rubber, heat-shrunk rubber, and biasable plastic. Bands 70A and 72A can be made of one of a variety of colors for the purpose of identifying the user as an identifiable competitor or as a member of a particular team.

Figure 7:
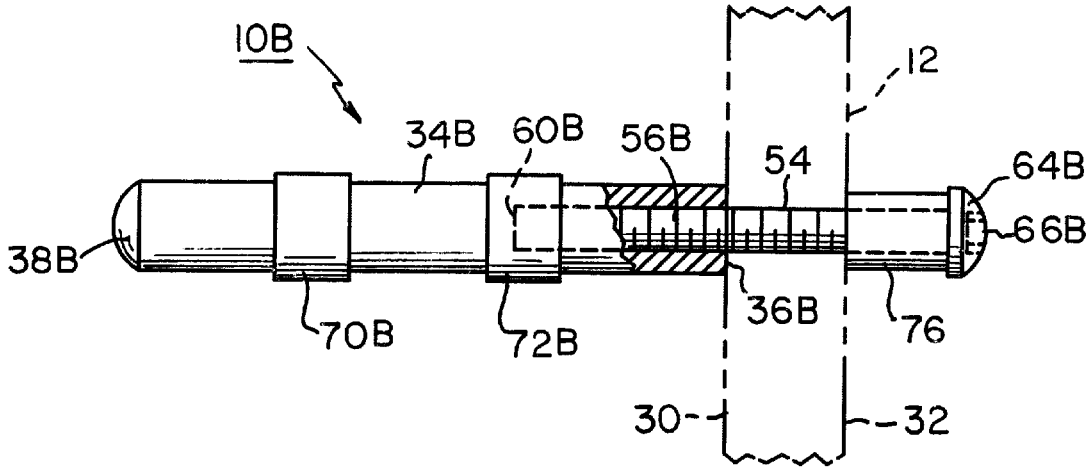
FIG. 7 is a side view analogous to the view shown in FIG. 4 with a locking washer mounted to the screw between the cap head and the trigger with the trigger shown in phantom line.

FIG. 7 is a view of a trigger attachment device 10B, which is analogous to trigger attachment device 10 shown in FIGS. 1–5 with trigger attachment device 10B being located on left side 22 relative to gun body 16 as is shown in FIGS. 1–5. In FIG. 7 as in FIGS. 1–5, trigger 12 has trigger left and right side planar walls 30 and 32, respectively, that are in association with left and right sides walls 22 and 24, respectively, of gun body 16. Trigger attachment device 10B includes a trigger extension bar 34B that has opposed proximal and distal ends 36B and 38B, respectively, with proximal end 36B positioned adjacent to trigger right side wall 30 and distal end 38B is positioned remote from trigger right side wall 32.

Trigger attachment device 10B includes a trigger extension bar 34B that has opposed bar proximal and distal ends 36B and 38B, respectively, with bar proximal end 36B positioned adjacent to trigger left side wall 30 and bar distal end 38B positioned remote from trigger left side wall 30. Bar distal end 38B is located beyond the left vertical plane 40 (as seen in FIG. 2) of gun body 16. Trigger extension bar 34B is transverse to trigger 12, and in particular is transverse to trigger left side wall 30. Trigger extension bar 34B is positioned to allow a user to hold gun 14 with the right hand of the user and to operate trigger 12 with the left hand or fingers of the user external to trigger 12, by pulling or striking trigger extension bar 34B in a rearward direction relative to marker gun 14 towards the body of the user, which operation causes trigger 12 to move backwards as if directly operated by the user to activate the firing mechanism of marker gun 14 although the hand of the user is external to trigger 12.

Two optional circular, or cylindrical, bands 70B and 72B are mounted in spaced relationship around cylindrical trigger extension bar 34B. Bands 70B and 72B are frictionally resistant to the movement of the hand of a user so that the hand achieves added grip during the pulling or striking action of the trigger activation. Bands 70B and 72B can be made of a variety of materials, among them being rubber, heat-shrunk rubber, and biasable plastic. Bands 70B and 72B can be made of one of a variety of colors for the purpose of identifying the user as an identifiable competitor or as a member of a particular team.

Trigger extension device 10B can optionally extend outwardly from right side 24 of gun body 24 mutatis mutandis in a manner analogous to trigger attachment device 10A as described above and as shown in FIG. 6.

Figure 8:
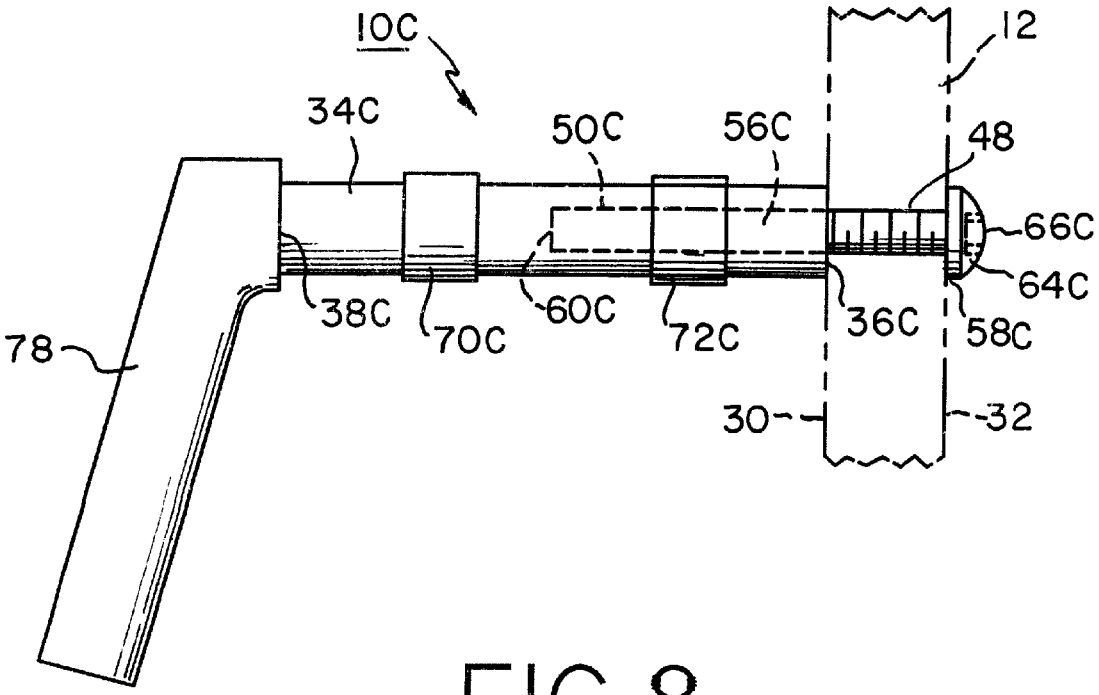
FIG. 8 is a side view analogous to the view shown in FIG. 4 showing a trigger extension device that includes a trigger extension bar and an added angled extension member connected to the trigger extension bar with the trigger shown in phantom line.

FIG. 8 is a view of a trigger attachment device 10C, which is analogous to trigger attachment device 10 shown in FIGS. 1–5. Trigger attachment device 10C includes a trigger extension bar 34C that has opposed bar proximal and distal ends 36C and 38C, respectively, with bar proximal end 36C positioned adjacent to left trigger side wall 30 and bar distal end 38C positioned remote from trigger left side wall 30 so that bar distal end 38C is located on left side 22 of gun body 16. Bar distal end 38C is located beyond the left vertical plane 40 of gun body 16. Trigger extension bar 34C is transverse to trigger 12, and in particular is transverse to trigger left side wall 30.

Trigger extension bar 34C is cylindrical and linear and is connected to trigger 12. Trigger 12 has a trigger connecting end 44 located at gun body 16 and a trigger free end 46 with trigger gripping portion 48 therebetween with extension bar proximal end 36C being located at left side wall 30 at trigger gripping portion 48. Trigger extension bar 34C defines an extension bar threaded bore 50C having a bore aperture 52C at bar proximal end 36C. Trigger 12 defines a threaded trigger hole 54 at trigger gripping portion 48 that extends perpendicularly between trigger left and right side walls 30 and 32. An elongated screw 56C extends transversely outwardly from left side 22 of gun body 16 and has a screw secured end 58C and an opposed screw distal end 60C. Elongated screw 56C is threadably mounted in extension bar threaded bore 50C with screw distal end 60C being positioned therein. Screw secured end 58C has a screw locking cap 64C spaced from trigger right side wall 32. Trigger 12 is positioned between screw locking cap 64C and bar proximal end 36C.

An angled extension bar member 78 is secured by heat attachment or is unitary with linear trigger extension bar 34C at extension bar distal end 38C. Angled extension bar member 78 is angled downwardly relative to trigger linear extension bar 34C, which in the firing mode is horizontally aligned. The angle between angled extension bar member 78 and linear trigger extension bar is approximately at right angles with FIG. 8 showing the angle to be slightly greater than ninety degrees. A user is thus able to pull or strike either trigger extension bar 34C or angled extension bar member 78 with the left hand during the firing mode. Bar member 78 can be cylindrical or optionally can be of another configuration such as rectangular.

Screw locking cap 64C defines either a cross-slot 66C for receiving the head of a screwdriver as shown in FIG. 1 or optionally a slot 66X for receiving the head of an Allen wrench as shown in FIG. 3A.

Two optional circular, or cylindrical, bands 70C and 72C are mounted in spaced relationship around cylindrical trigger extension bar 34C. Bands 70C and 72C are frictionally resistant to the movement of the hand of a user so that the hand achieves added grip during the pulling or striking action of the trigger activation. Bands 70C and 72C can be made of a variety of materials, among them being rubber, heat-shrunk rubber, and biasable plastic. Bands 70C and 72C can be made of one of a variety of colors for the purpose of identifying the user as an identifiable competitor or as a member of a particular team.

Trigger extensive device 10C can optionally extend outwardly from right side 24 of gun body 24 mutatis mutandis in a manner analogous to trigger attachment device 10A as described above and as shown in FIG. 6.

Figure 9A:
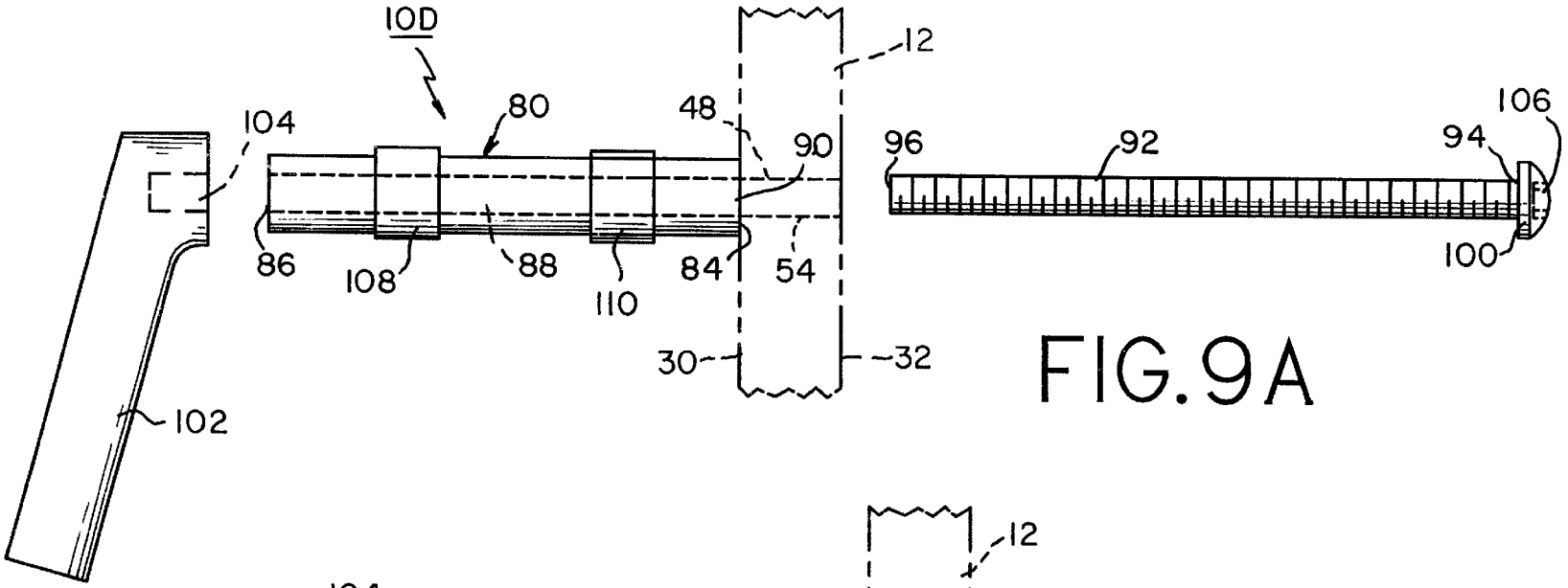
FIG. 9A is an exploded side view of a trigger extension device that includes a cylindrical trigger extension bar configured as a barrel that is to be rotatably mounted over an elongated screw connected to an angled extension member with the trigger shown in phantom line.
Figure 9B:
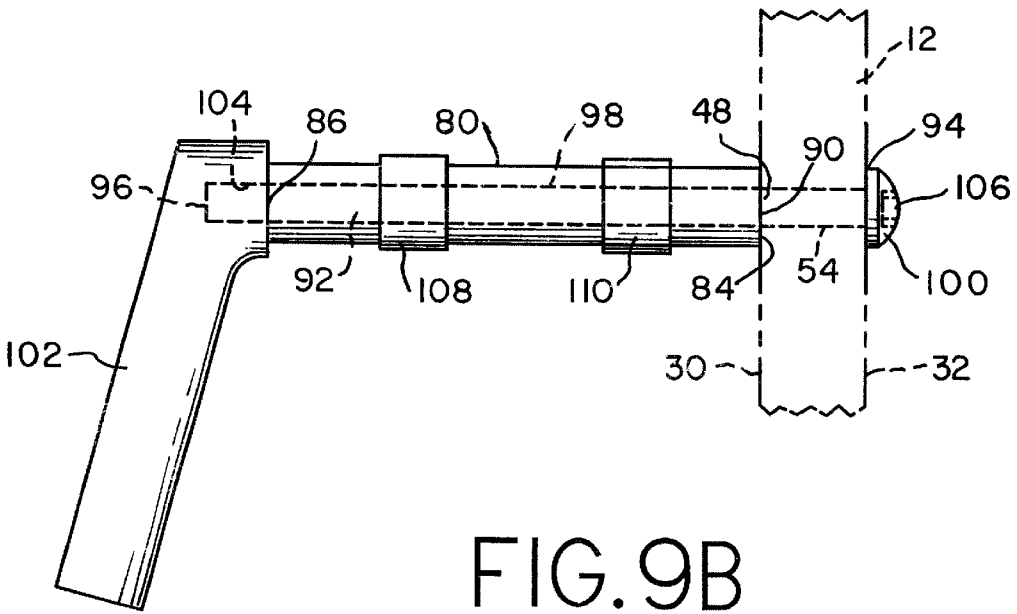
FIG. 9B is the assembled side view of the trigger extension device shown in FIG. 9A.

FIGS. 9A and 9B show a view of a trigger attachment device 10D, which is analogous to trigger attachment device 10 shown in FIGS. 1–5. Trigger attachment device 10D includes a trigger extension bar that is configured as an elongated cylindrical trigger barrel extension 80 having opposed barrel extension proximal and distal ends 84 and 86, respectively, with barrel proximal end 84 being positioned adjacent to left trigger side wall 30 and barrel distal end 86 being positioned remote from trigger left side wall 30 so that barrel distal end 86 is located on left side 22 of gun body 16. Barrel distal end 86 is located beyond the left vertical plane 40 (as seen in FIG. 2) of gun body 16. Trigger barrel extension 80 is transverse to trigger 12, and in particular is transverse to trigger left side wall 30.

Trigger barrel extension 80 is positioned to allow a user to operate trigger 12 by the left hand or fingers of the user external to trigger 12 by pulling or striking trigger barrel extension 80 in a rearward direction relative to marker gun 14 towards the body of the user, which operation causes trigger 12 to move backwards as if directly operated by the user to activate the firing mechanism of marker gun 14 although the hand of the user is external to trigger 12.

Trigger barrel extension 80 is cylindrical and linear and is connected to trigger 12. Trigger 12 has a trigger connecting end 44 located at gun body 16 and a trigger free end 46 with trigger gripping portion 48 therebetween with trigger barrel extension 80 distal end 86 being located at trigger gripping portion 48. Trigger barrel extension 80 defines an trigger barrel extension bore 88 having a bore aperture 90 at trigger gripping portion 48. Trigger 12 defines a threaded trigger hole 54 at trigger gripping portion 48 that extends perpendicularly between trigger left and right side walls 30 and 32. An elongated screw 92 extends transversely outwardly from left side 22 of gun body 16 and has a screw secured end 94 and an opposed screw distal end 96. Elongated screw 92 is mounted in and extends through barrel extension bore 88. Barrel bore 88 has a barrel diameter and elongated screw 92 has a screw diameter slightly less than the barrel diameter so that trigger barrel extension 80 is rotatably mounted to elongated screw 92. Screw secured end 94 has a screw locking cap 100 adjacent to trigger right side wall 32. Trigger 12 is positioned between screw locking cap 100 and bar proximal end 84 so that trigger barrel extension 80 and trigger 12 are held in interlocked relationship. Trigger barrel extension 80 is sufficiently spaced from left trigger side wall 30 to allow trigger barrel extension 80 to be rotatable about elongated screw 92.

An angled extension bar member 102 is attached to trigger barrel extension 80 at trigger barrel extension distal end 86. Angled extension bar member 102 is angled downwardly relative to linear trigger barrel extension 80. The downward angle of angled extension bar member 102 relative to trigger barrel extension 80 is approximately at right angles with FIG. 9B showing a downward and outward angle slightly greater than ninety degrees. A user is thus able to pull or strike either trigger barrel extension 80 or angled extension bar member 102 during the firing mode.

Angled extension bar member 102 defines an angled extension bar member axial threaded bore 104 that is axially aligned with barrel axial bore 88 and axially aligned with elongated screw 92. Distal end 86 of elongated screw 92 is threaded into mounted relationship with angled extension bar member 102 at angled bar threaded bore 104 as particularly seen in FIG. 9B.

Screw locking cap 100 defines either a cross-slot 106 for receiving the head of a screwdriver or optionally defines a slot for receiving the head of an Allen wrench as shown in FIG. 3.

Two optional circular, or cylindrical, bands 108 and 110 are mounted in spaced relationship around cylindrical trigger barrel extension 80. Bands 108 and 110 are frictionally resistant to the movement of the hand of a user so that the hand achieves added grip during the pulling or striking action of the trigger activation. Bands 108 and 110 can be made of a variety of materials, among them being rubber, heat-shrunk rubber, and biasable plastic. Bands 108 and 110 can be made of one of a variety of colors for the purpose of identifying the user as an identifiable competitor or as a member of a particular team.

Trigger extension barrel extension 80 is positioned to allow a user to operate trigger 12 by the left hand of fingers of the user external to trigger 12, by pulling or striking trigger extension bar 34D in a rearward direction relative to marker gun 14 towards the body of the user, which operation causes trigger 12 to move backwards as if directly operated by the user to activate the firing mechanism of marker gun 14 although the hand of the user is external to trigger 12. Trigger extension barrel 80 will rotate about elongated screw 92 when the user strikes trigger extension barrel 80. In addition, the user can also strike angled extension bar member to operate trigger 12.

Trigger extension device 10D can optionally extend outwardly from right side 24 of gun body 24 mutatis mutandis in a manner analogous to trigger attachment device 10A as described above and as shown in FIG. 6.

Figure 10:
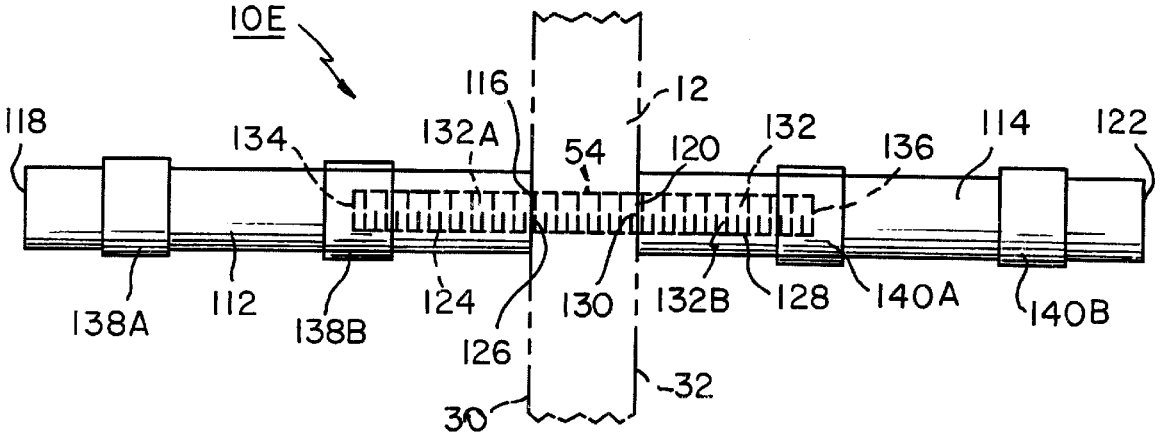
FIG. 10 is a side view of a trigger extension device having an opposed pair of trigger extension bars extending from both sides of the trigger which is shown in phantom line.

FIG. 10 shows a trigger attachment device 10E analogous to trigger attachment device 10 shown in FIGS. 1–5. Trigger attachment device 10E includes left and right trigger extension bars 112 and 114 attached to the left and right sides, respectively, of paint ball marker gun 14 and specifically extend transversely outwardly from the left and right sides 22 and 24 of gun body 16.

The leftward and rightward extending aspects of trigger attachment device 10E provide a user the opportunity to hold marker gun 14 with the right hand and to operate trigger 12 by striking the forward side of left trigger attachment device 112 with the palm or fingers of the left hand with a rearward motion, that is, from gun front portion 18 towards gun rear portion 20, or alternatively, the leftward and rightward extending aspects of trigger attachment device 10E provides a user the opportunity to hold marker gun 14 with the left hand and to operate trigger 12 by striking the forward side of right trigger attachment device 114 with the palm or fingers of the right hand with a rearward motion, that is, from gun front portion 18 towards the gun rear portion 20.

The result in either action would be that trigger 12 is pulled rearwardly so as to activate the firing mechanism of marker gun 14 to fire a paint ball.

Left and right trigger extension bars 112 and 114 are cylindrical and linear and are each connected to trigger 12 at trigger gripping portion 48. Left trigger extension bar 112 has left trigger extension bar proximal and distal ends 116 and 118, respectively, with left proximal end 114 being adjacent to trigger left side wall 30. Right trigger extension bar 114 has right trigger extension bar proximal and distal ends 120 and 122, respectively, with right proximal end 120 being adjacent to trigger right side wall 32. Trigger extension bar left and right distal ends 118 and 122 are positioned beyond the left and right vertical planes 40 and 42 (as seen in FIG. 2) of gun body 16. Left trigger extension bar 112 defines a left extension bar axial threaded bore 124 having a left bore aperture 126 at proximal end 116. Right trigger extension bar 114 defines a right extension bar axial bore 128 having a right bore aperture 130 at right proximal end 120. Trigger 12 defines a threaded trigger hole 54 at trigger gripping portion 48 that extends perpendicularly between trigger left and right side walls 30 and 32. A unitary elongated screw 132 has a screw opposed left and right ends 134 and 136, respectively. Elongated screw 134 is threadably mounted in threaded trigger hole 54 with screw left end 134 being positioned therein. Unitary elongated screw 132 includes left and right screw portions 132A and 132B, respectively, that are positioned in left and right threaded bores 124 and 128, respectively. Elongated screw left end 134 is mounted in extension bar left threaded bore 124, and elongated screw right end 136 is mounted in extension bar right threaded bore 126 with screw right end 136 positioned therein. Left bore aperture 126 and right bore aperture 130 are aligned with opposed sides of threaded trigger hole 54 and elongated screw 132 threadably extends through left and right bore apertures 126 and 128 and threadably extends through trigger hole 54.

Trigger 12 is positioned between left and right trigger extension bar proximal ends 116 and 120 so that left and right trigger extension bars 112 and 114 and trigger 12 are held in interlocked relationship.

Two optional circular, or cylindrical, bands 138A and 138B are mounted in spaced relationship around cylindrical left trigger extension bar 112. Likewise, two optional circular, or cylindrical, bands 140A and 140B are mounted in spaced relationship around cylindrical right trigger extension bar 114. Bands 138A and 138B and bands 140A and 140B are frictionally resistant to the movement of the hand of a user so that the hand achieves added grip during the pulling or striking action of the trigger activation. Bands 138A, 138B, 140A and 140B can be made of a variety of materials, among them being rubber, heat-shrunk rubber, and biasable plastic. Bands 138A, 138b, 140A and 140B can be made of one of a variety of colors for the purpose of identifying the user as an identifiable competitor or as a member of a particular team.

Figure 11:
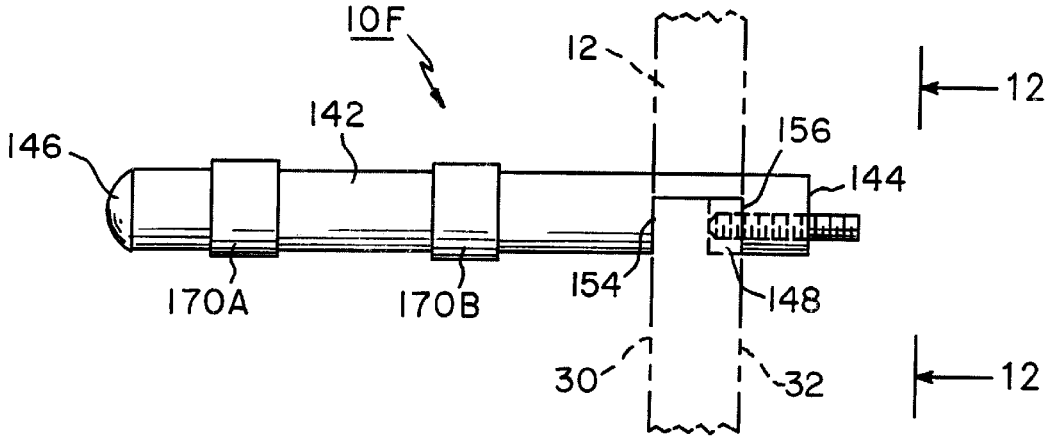
FIG. 11 is a side view of another embodiment of a trigger extension device taken from the rearward side of the trigger showing the trigger mounted in a recess in the trigger and the trigger extension bar held in a cutout in the trigger by a set screw.
Figure 12:
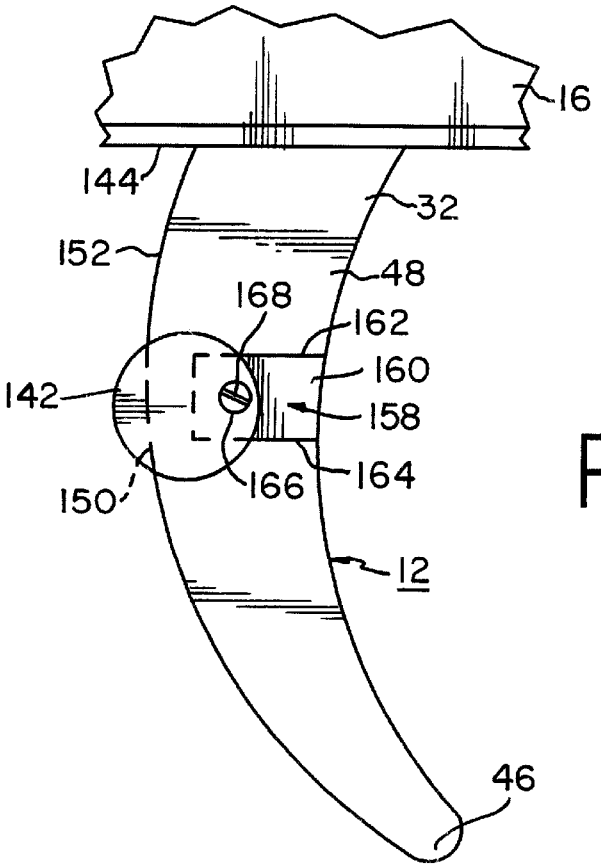
FIG. 12 is a side view of the set screw connector shown in FIG. 11.
Figure 13:
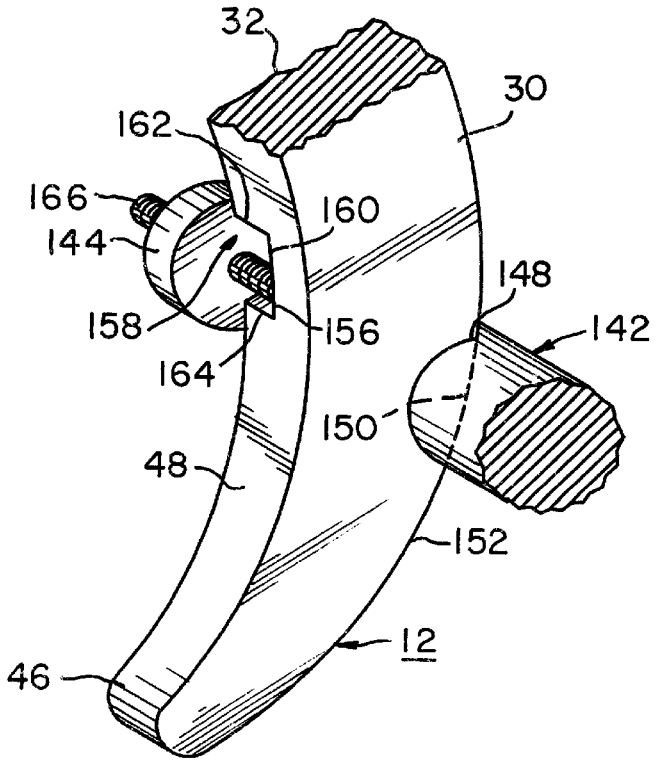
FIG. 13 is a broken perspective view of a portion of the trigger positioned in a recess in the trigger extension bar and the extension bar positioned in a trigger cutout where it is held by a set screw connector.

FIGS. 11–13 show a trigger attachment device 10F analogous to trigger attachment device 10 shown in FIGS. 1–5. Trigger attachment device 10F includes a trigger extension bar 142 attached to the left side 22 (as seen in FIG. 2) of gun body 16 of paint ball marker gun 14 and specifically extends transversely outwardly from the left side 22 of gun body 16.

The leftward extending aspect of trigger attachment device 10F provides a user the opportunity to hold marker gun 14 with the right hand and to operate trigger 12 by striking the forward side of left trigger attachment device 10F with the palm or fingers of the left hand with a rearward motion, that is, from gun front portion 18 towards gun rear portion 20. The result would be that trigger 12 is pulled rearwardly so as to activate the firing mechanism of marker gun 14 to fire a paint ball.

Trigger extension bar 142 includes connecting and distal ends 144 and 146, respectively, with distal end 146 being positioned beyond the left vertical plane 40 (as seen in FIG. 2) of gun body 16. Trigger extension bar 142 defines an extension bar recess 148 having a recess curved inner surface 150 seen in FIG. 13. The curved rear wall 152 of trigger 12 shown in FIGS. 12 and 13 is positioned in recess 148 with curved rear wall 152 being in association with recess curved inner surface 150. Trigger left and right side walls 30 and 32 are also positioned in association with the opposed left and right side walls of trigger extension bar recess 148.

Trigger 12 defines a trigger cutout 158 at trigger gripping portion 48 at trigger right side wall 32. Cutout 158 includes a cutout inner side wall 160 lateral to trigger 12 and further includes cutout upper and lower walls 162 and 164, respectively that are transverse to trigger 12. Trigger extension bar connecting end 144, shown in FIGS. 11, 12, and 13, is positioned adjacent to trigger right side wall 32. A set screw 166 is threadably mounted to extension bar connecting end 144 and extends in transverse relationship to trigger 12 through a threaded bore in trigger extension bar connecting end 144 into trigger cutout 154 in perpendicular orientation to cutout inner side wall 160. As shown in FIG. 12, set screw 166 is provided with a slot recess 168 for receiving a screwdriver head for rotating set screw 166 into locked relationship with cutout inner side wall 160 with the result that trigger extension bar 142 and trigger 12 are held in interlocked relationship.

Two optional circular, or cylindrical, bands 170A and 170B are mounted in spaced relationship around cylindrical trigger extension bar 142. Bands 170A and 170B are frictionally resistant to the movement of the hand of a user so that the hand achieves added grip during the pulling or striking action of the trigger activation. Bands 170A and 170B can be made of a variety of materials, among them being rubber, heat-shrunk rubber, and biasable plastic. Bands 170A and 170B can be made of one of a variety of colors for the purpose of identifying the user as an identifiable competitor or as a member of a particular team.

Trigger extension device 10F can optionally extend outwardly from right side 24 of gun body 24 mutatis mutandis in a manner analogous to trigger attachment device 10A as described above and as shown in FIG. 6.

While this invention has been described in detail with particular reference to preferred embodiments thereof, it will be understood that variations and modifications will be effected within the spirit and scope of the invention as described herein and as defined in the appended claims.

What is claimed is:

1. A device attached to a trigger of a paint ball marker gun used in the sport of paint ball marking, the marker gun including a gun body having front and rear portions and left and right sides relative to said front and rear portions, the trigger having opposed trigger left and right side walls, comprising:

bar means for providing a trigger extension for a user to operate the trigger by hand at a position remote from the trigger, said bar means includes a trigger extension bar having extension bar proximal and distal ends, said trigger extension bar proximal end being positioned adjacent to one of the trigger left and right side walls, said trigger extension bar distal end being positioned remote from said one of the left and right trigger side walls; and means for connecting said bar means to the trigger in transverse orientation to the left and right trigger side walls, wherein said extension bar is linear and is perpendicular to the left and right trigger walls and has a cylindrical configuration.

2. The device according to claim 1, wherein said extension bar has a knurled cylindrical surface.

3. The device according to claim 1, further including at least one circular band mounted around said cylindrical extension bar, said band being made of a material that is frictionally resistant to the movement of the hand of a user.

4. The device according to claim 3, wherein said material is rubber.

5. The device according to claim 4, wherein rubber is heat shrunk rubber.

6. The device according to claim 3, wherein said material is a biasable plastic.

7. The device according to claim 3, wherein said at least one band is a plurality of bands.

8. The device according to claim 7, wherein said plurality of bands are colors marked.

9. A device attached to a trigger of a paint ball marker gun used in the sport of paint ball marking, the marker gun including a gun body having front and rear portions and left and right sides relative to said front and rear portions, the trigger having opposed trigger left and right side walls, comprising:

bar means for providing a trigger extension for a user to operate the trigger by hand at a position remote from the trigger, said bar means includes a trigger extension bar having extension bar proximal and distal ends, said trigger extension bar proximal end being positioned adjacent to one of the trigger left and right side walls, said trigger extension bar distal end being positioned remote from said one of the left and right trigger side walls; and means for connecting said bar means to the trigger in transverse orientation to the left and right trigger side walls, wherein the trigger includes a trigger connecting end and an opposed trigger free end and a trigger gripping portion therebetween, said trigger connecting end being located at the gun body, and wherein said means for connecting includes said trigger defining a threaded trigger hole extending perpendicularly between said trigger side walls and located in association with said trigger gripping portion, and wherein said means for connecting further includes an elongated screw having a screw portion threadably mounted in said trigger hole.

10. The device according to claim 9, wherein said means for connecting further includes said trigger extension bar defining a trigger extension bar threaded bore, said elongated screw being threadably mounted in said trigger extension bar threaded bore.

11. The device according to claim 10, wherein said elongated screw has a screw secured end and an opposed screw distal end, said screw secured end having a screw locking cap positioned adjacent to the other one of said one of said left and right trigger walls, the trigger being positioned between said screw locking cap and said bar proximal end, whereby said extension bar and the trigger are held in locked relationship.

12. The device according to claim 11, further including an angled extension bar member secured to said linear extension bar at said extension bar distal end, said angled extension bar member being angled relative to said linear extension bar.

13. The device according to claim 11, wherein said screw locking cap defines a slot for receiving the head of a screwdriver.

14. The device according to claim 10, wherein said elongated screw has a screw secured end and an opposed screw distal end, said screw secured end having a screw locking cap and further including a locking washer mounted to said elongated screw positioned adjacent to the other one of said one of said left and right of trigger walls and adjacent to said screw locking cap, wherein said screw secured end is positioned proximate to said one of the trigger left and right side walls, the trigger being positioned between said locking washer and said bar proximal end, whereby said extension bar and the trigger are held in locked relationship.

15. The device according to claim 9, wherein said means for connecting further includes said trigger extension bar being an elongated cylindrical barrel having opposed proximate and distal ends, said barrel defining a barrel axial cylindrical bore having a barrel bore proximate and distal apertures, said barrel bore having a barrel diameter, said elongated screw having a screw diameter slightly less than said barrel diameter, and wherein said elongated screw extends through said barrel bore, whereby said barrel is rotatably mounted to said elongated screw, and further wherein said elongated screw has a screw secured end and an opposed screw distal end, said screw secured end having a screw locking cap positioned adjacent to the other one of said one of said left and right trigger walls, the trigger being positioned between said screw locking cap and said bar proximal end, whereby said extension bar and the trigger are held in locked relationship.

16. The device according to claim 10, wherein said bar means further includes another trigger extension bar having another trigger extension bar proximal and distal ends, said another trigger extension bar proximal end being positioned adjacent to the other one of said one of the left and right trigger walls, said trigger extension bar distal end being positioned remote from said other one of said one of the left and right trigger walls.

17. The device according to claim 16, wherein said means for connecting further includes said another trigger extension bar defining another trigger extension bar axial internal bore, said another trigger extension bar bore having another trigger extension bar bore internal screw threads, said elongated screw being mounted in said another trigger extension bar bore in threaded relationship with said another trigger extension bar, said elongated screw having opposed screw free ends, one of said screw free ends being positioned within said trigger extension bar bore and the other of said screw free ends being positioned within said another trigger extension bar bore.

18. A device attached to a trigger of a paint ball marker gun used in the sport of paint ball marking, the marker gun including a gun body having front and rear portions and left and right sides relative to said front and rear portions, the trigger having opposed trigger left and right side walls, comprising:

bar means for providing a trigger extension for a user to operate the trigger by hand at a position remote from the trigger, said bar means includes a trigger extension bar having extension bar proximal and distal ends, said trigger extension bar proximal end being positioned adjacent to one of the trigger left and right side walls, said trigger extension bar distal end being positioned remote from said one of the left and right trigger side walls; and means for connecting said bar means to the trigger in transverse orientation to the left and right trigger side walls, wherein said means for connecting includes said trigger extension bar defining a recess, said trigger being positioned in said recess, the trigger defining a trigger cutout in association with said of one of the trigger left and right side walls, and further including a set screw axially mounted to said trigger extension bar in association with said trigger cutout, said trigger cutout having opposed cutout inner and outer side walls, said extension bar being positioned in said trigger cutout, said set screw being threaded pressure contact with said trigger cutout inner side wall.

19. A device attached to a trigger of a paint ball marker gun used in the sport of paint ball marking, the marker gun including a gun body having front and rear portions and left and right sides relative to said front and rear portions, the trigger having opposed trigger left and right side walls, comprising:

bar means for providing a trigger extension for a user to operate the trigger by hand at a position remote from the trigger, said bar means includes a trigger extension bar having extension bar proximal and distal ends, said trigger extension bar proximal end being positioned adjacent to one of the trigger left and right side walls, said trigger extension bar distal end being positioned remote from said one of the left and right trigger side walls; and means for connecting said bar means to the trigger in transverse orientation to the left and right trigger side walls, wherein the gun body extends to opposed left and right vertical gun body planes in the upright position, and wherein said trigger bar distal end is positioned beyond the left and right bun body plane associated with said one of the left and right trigger side walls.

* * * * *